US006026783A

United States Patent [19]

Nestvall et al.

[11] Patent Number: 6,026,783

[45] Date of Patent: Feb. 22, 2000

[54] DEVICE AND METHOD FOR CALIBRATION OF A THROTTLE ARRANGEMENT

[75] Inventors: Per Nestvall, Mölndal; Mats Dahlgren, Stocksund, both of Sweden

[73] Assignee: AB Volvo Penta, Sweden

[21] Appl. No.: 08/981,876

[22] PCT Filed: Jun. 18, 1996

[86] PCT No.: PCT/SE96/00793

§ 371 Date: May 6, 1995

§ 102(e) Date: May 6, 1998

[87] PCT Pub. No.: WO97/03282

PCT Pub. Date: Jan. 30, 1997

[30] Foreign Application Priority Data

Jul. 7, 1995 [SE] Sweden ..... 9502550

[51] Int. Cl.[7] ..... F02D 1/00

[52] U.S. Cl. ..... 123/399; 73/1.75

[58] Field of Search ..... 123/399, 400; 73/1.75, 1.88

[56] References Cited

FOREIGN PATENT DOCUMENTS

| | | |
|---|---|---|
| 0 110 226 A2 | 6/1984 | European Pat. Off. . |
| 0 203 273 A1 | 12/1986 | European Pat. Off. . |
| 0 385 813 A2 | 9/1990 | European Pat. Off. . |
| 0 647 773 A2 | 4/1995 | European Pat. Off. . |

*Primary Examiner*—John Kwon

*Attorney, Agent, or Firm*—Lerner, David, Littenberg, Krumholz & Mentlik, LLP

[57] ABSTRACT

Methods and apparatus for calibrating throttles for engines are disclosed with the methods including positioning the throttle in a predetermined position, detecting that position, and acknowledging the predetermined degree of application of the throttle whereby that predetermined degree of application is locked into correspondence with the predetermined position of the throttle for subsequent use of the throttle. The disclosed apparatus includes an actuator for locking a predetermined position of the throttle within the range of positions into correspondence with a predetermined degree of application of the throttle and acknowledging that predetermined degree of application of the throttle, and a detector for detecting the predetermined position of the throttle.

14 Claims, 1 Drawing Sheet

DEVICE AND METHOD FOR CALIBRATION OF A THROTTLE ARRANGEMENT

FIELD OF THE INVENTION

The present invention relates to a method for calibration of a throttle arrangement. The present invention also relates to a device for calibration of a throttle arrangement.

BACKGROUND OF THE INVENTION

A throttle arrangement of the type which comprises a lever which is pivotally mounted in a bracket is normally used for propulsion of motor boats. The lever can be positioned in a neutral position, which corresponds to idling of the engine, and can also be swung in the forwards and rearwards directions in the bracket for setting a predetermined degree of throttle application in the forwards or rearwards direction of the boat. Normally, the throttle arrangement is connected to the engine by means of a wire which mechanically transfers the movements of the lever. Throttle arrangements which comprise an electrical detector by means of which the position of the lever is detected have also been developed in recent years. The position of the lever in this case can be read by a control unit. The control unit controls the operation of the boat's engine according to the set degree of throttle application.

In the field of throttle arrangements, a problem may arise due to the fact that the lever may present a relatively large stroke, i.e. it requires a large geometrical space in order to be adjustable so as to assume all positions ranging from full throttling in the forwards direction to full throttling in the rearwards direction. As a consequence, if for example the throttle arrangement is mounted close to other objects in the boat, the entire stroke of the lever cannot be used. For this reason, there is a need to be able to calibrate the setting of the throttle arrangement, for example so that full throttling is obtained when the lever is positioned halfway along its stroke. In particular, there is a demand for devices and methods for calibration of the modern type of throttle arrangement which comprises a detector which is connected to a control unit.

Another problem in connection with the above-mentioned throttle arrangement arises when the engine is idling. Depending, for example, on the type of boat which is used, how the throttle arrangement is set, and how the engine is arranged in the boat, there is a risk that resonance may arise at the idling speed of the engine. This may lead to problems in the form of heavy noise and unwanted vibrations in the boat. Consequently, there is a demand for fine tuning of the idling speed of the engine in a simple and effective manner, so that a particular setting of the throttle arrangement in the idling position always provides an idling speed at which the resonance phenomenon can be minimized.

SUMMARY OF THE INVENTION

Consequently, an object of the present invention is to solve the above-mentioned problems and to provide a method which allows for simple and effective calibration of a throttle arrangement primarily intended for boat engines. This is accomplished by means of a method of the type initially mentioned. The object is also accomplished by means of a device of the type initially mentioned.

In this context, the term "calibration" is intended to describe the fact that a predetermined set position of the throttle arrangement is locked to a predetermined, desired degree of throttle application of the engine.

According to the present invention, these and other objects have now been accomplished by the discovery of a method for calibration of a throttle for an engine which is movable within a range of positions, the method comprising positioning the throttle in a predetermined position with the range of positions, detecting the predetermined position of the throttle, and acknowledging the predetermined degree of application of the throttle whereby the predetermined degree of application of the throttle is locked into correspondence with the predetermined position of the throttle for subsequent use of the throttle.

In a preferred embodiment, acknowledging of the predetermined degree of application of the throttle comprises storing the predetermined degree of application of the throttle and the corresponding predetermined position of the throttle in a memory. In a preferred embodiment, the method includes controlling the engine associated with the throttle by reading the memory. In another embodiment, the method includes controlling the engine associated with the throttle by means of the detected predetermined position of the throttle.

In accordance with another embodiment of the method of the present invention, acknowledging of the predetermined degree of application of the throttle comprises pressing at least one key on a keyboard thereby providing a signal associated with the degree of application of the throttle, and controlling the engine associated with the throttle by means of the signal.

In accordance with another embodiment of the method of the present invention, the method is carried out while the engine associated with the throttle is running, whereby the predetermined degree of application of the throttle corresponds to the idling speed of the engine.

In accordance with the present invention, apparatus has also been discovered for calibration of a throttle for an engine movable within a range of positions which comprises locking means for locking a predetermined position of the throttle within the range of positions into correspondence with the predetermined degree of application of the throttle, and a detector for detecting the predetermined position of the throttle, the locking means including an actuator for acknowledging the predetermined degree of application of the throttle.

In a preferred embodiment, the apparatus includes a memory for storing the predetermined degree of application of the throttle and the corresponding predetermined position of the throttle. Preferably, the apparatus includes a control unit for operating the engine associated with the throttle, the control unit operating the engine by reading the memory. In a preferred embodiment, the control unit controls operation of the engine associated with the throttle based upon the detected predetermined position of the throttle.

In accordance with another embodiment of the apparatus of the present invention, the apparatus includes a keyboard comprising a plurality of keys for providing a signal associated with the degree of application of the throttle to the control unit.

In accordance with another embodiment of the apparatus of the present invention, the predetermined idling speed of the engine.

BRIEF DESCRIPTION OF THE DRAWINGS

The present invention will be described in the following detailed description in greater detail with reference to the annexed drawings, in which.

DETAILED DESCRIPTION

Figure 1:
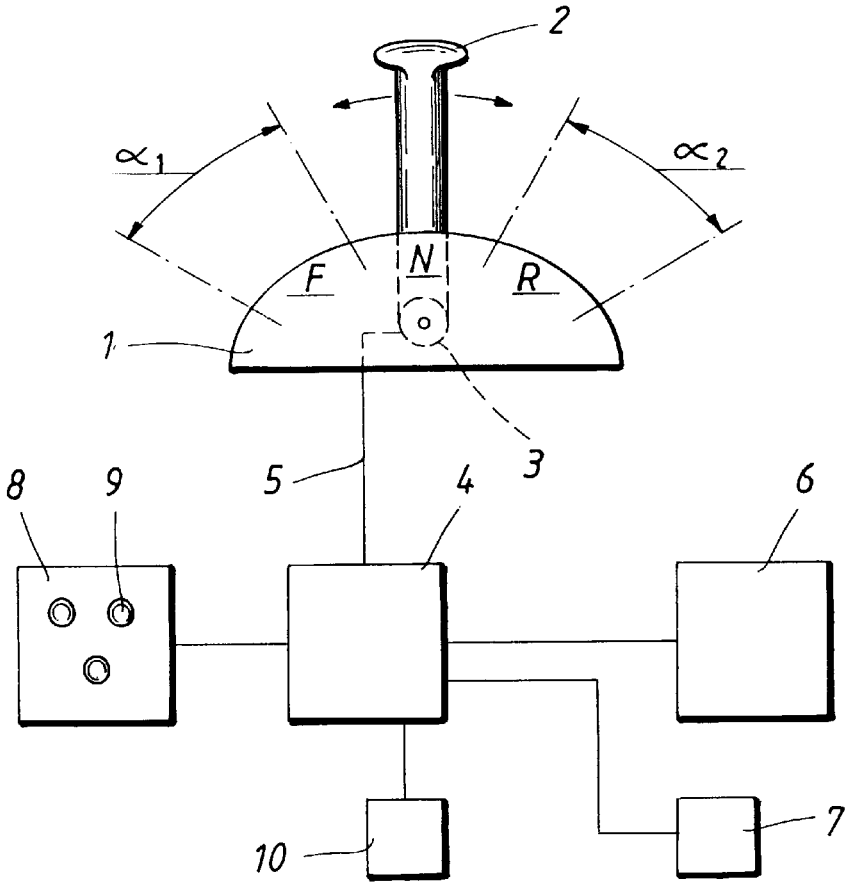
FIG. 1 is a schematic representation of the present invention.

Referring to the Figures, in which like referenced numerals refer to like elements thereof, FIG. 1 shows in a simplified, schematical manner a device according to the present invention. According to a preferred embodiment of this invention, the device comprises a bracket 1 which is intended to be arranged in a motor boat. A throttle arrangement 2 in the form of a lever is mounted in the bracket 1. In a manner which is known, the throttle arrangement 2 is pivotally arranged around an axis of rotation (not shown) which is arranged in the bracket 1. In this manner, the throttle arrangement 1 can be swung forwards and backwards in the bracket 1.

The throttle arrangement 2 can be set in a certain neutral position N which corresponds to idling of the engine. In this position (which is the position shown in FIG. 1), the throttle arrangement 2 is preferably essentially vertically arranged. The throttle arrangement 2 can also be set in a position F which corresponds to the throttle arrangement 2 being within the angle interval $\alpha_1$. When the F position is assumed, a gear for propulsion of the engine in the forwards direction is engaged. The magnitude of throttle application increases within the F position from a minimal degree of throttle application to a maximum degree of throttle application the further away from the vertical position the throttle arrangement 2 is positioned. In a corresponding manner, the throttle arrangement 2 can be positioned in a position R for reverse propulsion. This corresponds to the angle range $\alpha_2$.

Furthermore, the throttle arrangement 2 is connected to a detector in the form of a rotary potentiometer 3, the resistance of which depends on the position in which the throttle arraignment 2 is set. The rotary potentiometer 3 is connected to a control unit 4 by means of an electrical connection 5. Preferably, the control unit 4 is computer based and is adapted to determine the magnitude of the resistance of the potentiometer 3. Based on this determined magnitude, a corresponding value of the degree of throttle application is derived in the control unit 4, i.e. a value corresponding to the current angular position of the throttle arrangement 2 in the bracket 1.

The control unit 4 is connected to the boat's engine 6, which may be a diesel engine, gasoline engine or an engine of some other type. In a manner which is known, the engine 6 can be fed with a fuel mixture by means of an injection device (not shown). The control unit 4 is adapted to influence the injection device to deliver a suitable fuel mixture to the engine 6, so that the engine can be operated with a degree of throttle application which corresponds to a set position of the throttle arrangement 2, i.e. which depends on the current value of the resistance of the potentiometer 3. An engine speed counter 7 is preferably arranged in connection with the engine 6, which speed counter forwards a value representing the engine speed to the control unit 4.

Furthermore, the throttle arrangement 2 may be provided with a switch (not shown) which senses whether the N position is engaged or not. This condition can be detected by the control unit 4 and may, for example, be used in order to prevent the engine from being started unless the throttle arrangement 2 is positioned in the N position.

In accordance with the present invention, an actuation device 8 is connected to the control unit 4. The actuation device 8 preferably comprises a keyboard comprising a number of buttons or keys 9, which for example may be three in number. The actuation means 8 can be used in the following manner during calibration of the throttle arrangement 2.

Figure 2:
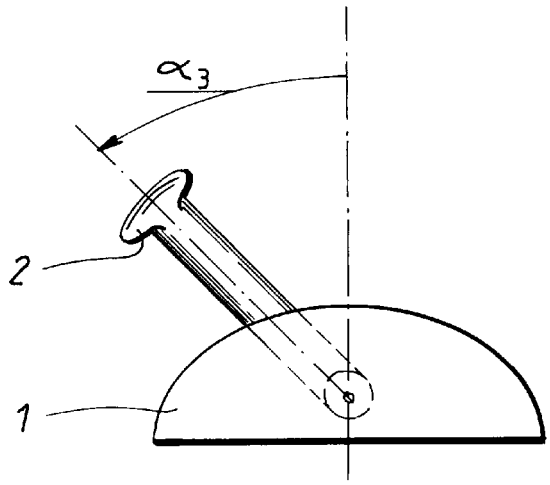
FIG. 2 is a partial schematic representation of the present invention during calibration.

When the throttle arrangement 2 is to be calibrated, a check whether the throttle arrangement 2 is positioned in the N position is first performed in the control unit 4. If this is the case, a predetermined key 9 on the actuation means 8 is pressed. Preferably, this can be acknowledged by means of a light (not shown) or the like on the actuation means 8 or the bracket 1. This indicates that the calibration is about to commence. Thereafter, the throttle arrangement 2 is set in a certain angular position $\alpha_3$, in accordance with that shown in FIG. 2, which is a simplified drawing of a throttle arrangement 2 in a bracket 1. The current angular position $\alpha_3$ is intended to correspond to a certain magnitude of the degree of throttle application, for example, full throttling in the forward direction. When the throttle arrangement 2 has been positioned in the desired angular position $\alpha_3$, a certain key of the actuation means 8 is pressed. This key is chosen beforehand so as to correspond to the desired degree of throttle application. Consequently, it constitutes an acknowledgment of the fact that the desired degree of throttle application is to be locked to the desired angular position.

The control unit 4 receives the signal from the actuation means 8 and detects that the current key corresponds to full throttle application. Thereafter, the control unit 4 stores both the current value of the resistance of the potentiometer 3 (which corresponds to the angular position $\alpha_3$) and the current degree of throttle application. These values are stored in a memory unit 10 associated with the control unit 4. In this manner, the angular position $\alpha_3$ is set so as to correspond to full throttling. When the engine 6 is subsequently started, a positioning of the throttle arrangement in the angular position $\alpha_3$ will be interpreted as a maximum degree of throttle application.

The calibration may proceed with setting of additional angular positions which can be locked to predetermined operational conditions (i.e. the degree of throttle application and the direction of propulsion ) of the engine 6, by pressing keys on the actuation means 8.

In accordance with a preferred embodiment, the present invention can be employed for calibration of the idling speed of the engine 6. In this case, the control unit 4 can be set to a certain operational condition by pressing a particular key on the actuation means 8. Thereafter, the engine is started in the conventional manner. In this present operational condition, the entire stroke of the lever now corresponds to a certain range of idling speeds, preferably from 550 to 700 rpm. The lever may now be positioned in a position in which a suitable idling speed is obtained, i.e. a speed which provides idling without generating any resonant noise or unwanted vibrations. Thereafter, a predetermined key on the actuation means 8 is pressed. This signifies that the current value of the speed of the engine 6 is detected by means of the speed detector 7 and is stored in the memory unit 10. The calibration of the idling speed is terminated by setting the throttle arrangement in the N position, which is detected by the control unit 4. During subsequent operation of the engine, the N position is locked to the idling speed which was stored in the memory unit 10 as stated above.

The invention is not limited to the above-mentioned embodiments, but may be varied within the scope of the subsequent claims. For example, various types of detectors 3 can be used. Furthermore, the actuation device 7 can be operated in different ways, for example by entering a certain sequence of keys in the form of a code. Alternatively, the operation may be carried out by keeping a certain key pressed for a certain time, which corresponds to a certain degree of throttle application.

Finally, the throttle arrangement 2 may comprise two levers which are mounted in one bracket. An arrangement of this type can be used in boats with two engines.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

We claim:

1. A method for calibration of a throttle for an engine which is movable within a range of positions, said method comprising positioning said throttle in a predetermined position within said range of positions, detecting said predetermined position of said throttle corresponding to a predetermined degree of application of said throttle, and acknowledging said predetermined degree of application of said throttle whereby said predetermined degree of application of said throttle is locked into correspondence with said predetermined position of said throttle for subsequent use of said throttle.

2. The method of claim 1 wherein said acknowledging of said predetermined degree of application of said throttle comprises storing said predetermined degree of application of said throttle and said corresponding predetermined position of said throttle in a memory.

3. The method of claim 2 including controlling said engine associated with said throttle by reading said memory.

4. The method of claim 3 including controlling said engine associated with said throttle by means of said detected predetermined position of said throttle.

5. The method of claim 3 wherein said acknowledging of said predetermined degree of application of said throttle comprises pressing at least one key on a keyboard thereby providing a signal associated with said degree of application of said throttle, and controlling said engine associated with said throttle by means of said signal.

6. The method of claim 1 carried out while said engine associated with said throttle is running, whereby said predetermined degree of application of said throttle corresponds to the idling speed of said engine.

7. The method of claim 1 wherein said engine comprises a marine engine.

8. Apparatus for calibration of a throttle for an engine movable within a range of positions comprising locking means for locking a predetermined position of said throttle within said range of positions into correspondence with a predetermined degree of application of said throttle, and a detector for detecting said predetermined position of said throttle, said locking means including an actuator for acknowledging said predetermined degree of application of said throttle.

9. The apparatus of claim 8, wherein said engine comprises a marine engine.

10. The apparatus of claim 8 including a memory for storing said predetermined degree of application of said throttle and said corresponding predetermined position of said throttle.

11. The apparatus of claim 10 including a control unit for operating said engine associated with said throttle, said control unit operating said engine by reading said memory.

12. The apparatus of claim 11 wherein said control unit controls operation of said engine associated with said throttle based upon said detected predetermined position of said throttle.

13. The apparatus of claim 11 including a keyboard comprising a plurality of keys for providing a signal associated with said degree of application of said throttle to said control unit.

14. The apparatus of claim 8 wherein said predetermined degree of application of said throttle corresponds to the idling speed of said engine.

* * * * *

UNITED STATES PATENT AND TRADEMARK OFFICE

CERTIFICATE OF CORRECTION

PATENT NO. : 6,026,783

DATED : February 22, 2000

INVENTOR(S) : Nestvall et al.

It is certified that error appears in the above-identified patent and that said Letters Patent is hereby corrected as shown below:

Column 2, line 59, after "predetermined" insert --degree of application of the throttle corresponds to the--.

Column 6, line 18, after "throttle" insert --whereby said predetermined degree of application of said throttle is locked into correspondence with said predetermined position of said throttle for subsequent use of said throttle--.

Signed and Sealed this

Thirteenth Day of February, 2001

*Attest:*

Nicholas P. Godici

NICHOLAS P. GODICI

*Attesting Officer*

*Acting Director of the United States Patent and Trademark Office*